United States Patent [19]

Ost et al.

[11] Patent Number: 4,811,455

[45] Date of Patent: Mar. 14, 1989

[54] WINDOW SPRING ANCHOR

[75] Inventors: Wilford G. Ost; Norman R. Westfall, both of Rochester, N.Y.

[73] Assignee: Caldwell Manufacturing Company, Rochester, N.Y.

[21] Appl. No.: 179,309

[22] Filed: Apr. 8, 1988

[51] Int. Cl.[4] ..... E05F 1/00

[52] U.S. Cl. ..... 16/197; 16/DIG. 16; 49/445

[58] Field of Search ..... 16/1 C, 193, 197, DIG. 16; 49/445, 446

[56] References Cited

U.S. PATENT DOCUMENTS

| | | | |
|---|---|---|---|
| 1,695,454 | 12/1928 | Coyne | 16/72 |
| 2,329,463 | 9/1943 | Froelich | 16/197 |
| 2,657,420 | 11/1953 | Carbary | 16/72 |
| 2,702,082 | 2/1955 | Wolf | 16/94 R |
| 3,051,976 | 9/1962 | Dubois et al. | 267/174 |
| 3,064,306 | 11/1962 | Beasley et al. | 16/197 |
| 3,116,520 | 1/1964 | MacGregor | 16/197 |
| 3,296,366 | 1/1967 | Bronikowski | 174/209 |
| 3,710,642 | 1/1973 | Schneider | 74/470 |
| 4,571,887 | 2/1986 | Haltof | 16/197 |
| 4,672,713 | 6/1987 | Newton et al. | 16/197 |
| 4,685,175 | 8/1987 | Yonovich | 16/193 |

*Primary Examiner*—Richard K. Seidel

*Attorney, Agent, or Firm*—Stonebraker, Shepard & Stephens

[57] ABSTRACT

A system of anchoring a window balance spring (16) in a channel (20) includes an arched anchor plate (10) connectable to spring (16) and having edge projections (15) that fit between the side walls (21) of the channel. When these and the bottom (22) of the channel are supported by a tool (30), anchor plate (10) is stamped flat against the channel bottom to spread edge projections (15) apart and drive them into the channel side walls (21) for a deformation interlock that holds the anchor and the spring reliably in place within the channel.

9 Claims, 2 Drawing Sheets

WINDOW SPRING ANCHOR

BACKGROUND

Block and tackle window balance springs are ordinarily arranged in metal channels that also contain a system of pulleys and a cord copperating with the balance spring, for counterbalancing a window sash. The spring, pulleys, and cord are preassembled into the channel and are then mounted in a window as a subassembly, ready to attach to a counterbalanced sash.

Such channel-mounted block and tackle window balance systems have encountered difficulty in anchoring one end of the spring to an end region of the channel. The spring force for these systems can be large, with a short spring travel distance that the block and tackle spreads over a longer distance, matching the vertical travel of the sash. Under such circumstances, the spring anchorage must resist several hundred pounds of force.

One way that springs have been anchored in channels, for window balance purposes, is a hook formed in a terminal coil of the spring to hook over a rivet that extends between side walls of the channel. The hook then becomes the weakest part of the spring, and the rivet between the channel walls requires a separate assembly and can also fail. Another anchorage uses cut and indented channel walls to form pockets that interlock with a spring anchoring clip, to which the spring is attached. This involves cutting and forming the channel walls in preparation for receiving the clip and also fabricating a clip in a suitable configuration.

We have discovered a simpler, less expensive, and more effective and reliable way of anchoring a counterbalance spring within a channel, for window balance purposes. Our anchor securely and reliably attached to the spring and then is made to interlock with the channel in a strong and secure way that does not required prefabricating pockets within the channel. Our anchor also accomplishes this at a lower cost than suitable alternatives.

SUMMARY OF THE INVENTION

Our system of anchoring a window balance spring within a channel includes an anchor plate secured to an end region of the spring, preferably by necking down terminal coils of the spring around a neck region of the anchor plate, to interlock with a head, adjacent the neck. The anchor plate is arched between opposed projections at its opposite edges, which can fit in between the side walls of the channel, with the central region of the anchor plate arching over the bottom of the channel. We then support the bottom and side walls of the channel in a tool and stamp the arched region of the anchor plate flat against the channel bottom. This spreads the projections apart and drives them into the side walls of the channel, which are supported by the tool. This deforms the side walls around the projections, within space that is available in the supporting tool, so that the channel side walls extend around each projection of the anchor plate and into recesses between projections. This interlocks the anchor plate into the deformed side walls of the channel so that the anchor plate can resist large forces applied by a counterbalance spring.

DRAWINGS

DETAILED DESCRIPTION

Figure 1:
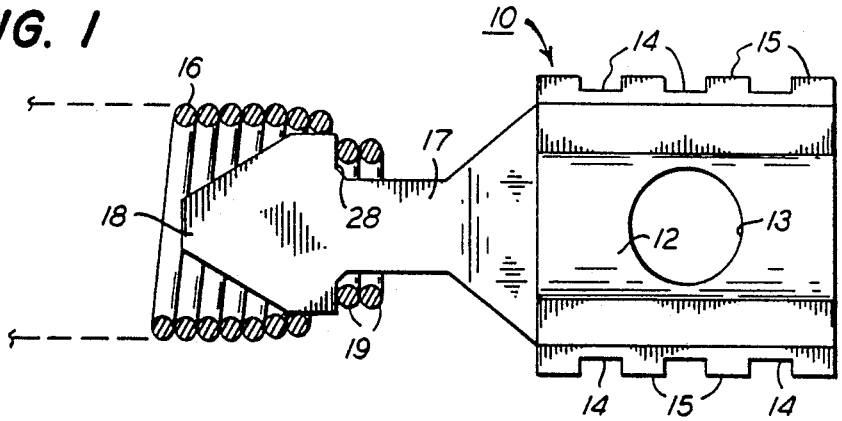
FIG. 1 is a partially cutaway, plan view of a preferred embodiment of our anchor plate connected to necked down terminal coils of a counterbalance spring.
Figure 2:
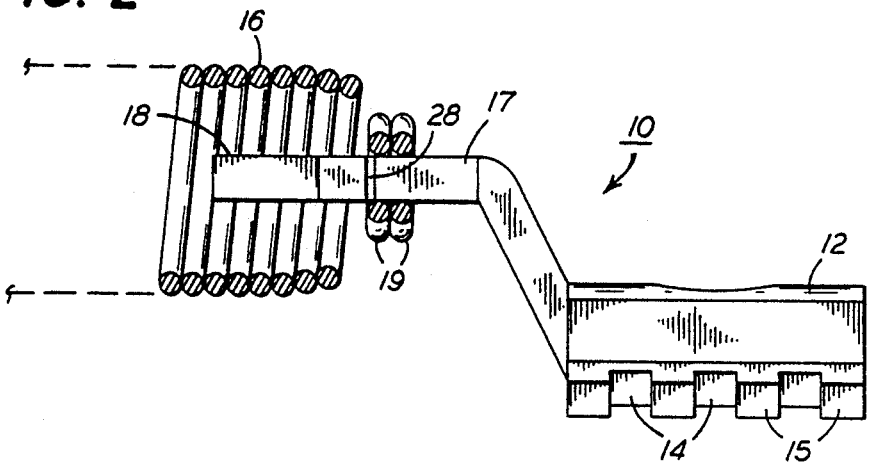
FIG. 2 is a partially cutaway, side elevational view of the anchor plate and spring of FIG. 1.
Figure 3:
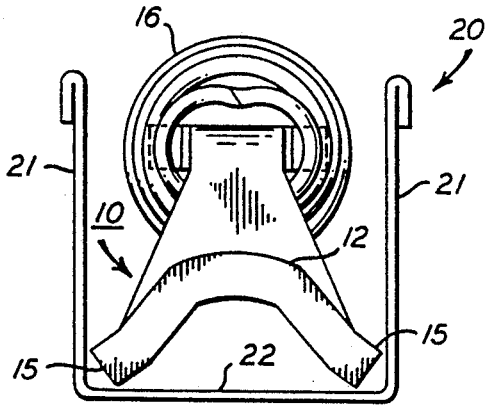
FIG. 3 is an end elevational view of the anchor plate and spring of FIGS. 1 and 2, arranged within a channel.

Our anchor plate 10 has an arch-shaped central region 12 between opposite side edges having projections 15 spaced apart by recesses 14. In its initial arched shape, as shown in FIG. 1–3, the edge projections 15 of anchor plate 10 can fit between side walls 21 of channel 20, just above channel bottom 22. The number of projections 15 and recesses 14 can vary, and these can also have shapes other than the square shape that we prefer. Hole 13 in arched region 12 receives a positioning tool and is otherwise not necessary to the functioning of anchor plate 10.

To attach anchor plate 10 to window balance spring 16, neck 17 is offset from arched region 12 so that head 18 can enter the end of spring 16. Then terminal coils 19 of spring 16 are necked down around neck 17 to interlock with abutment surface 28 on head 18. Necked down coils 19 are at least as strong as spring 16 and form a reliable interlock with anchor head 18.

Figure 4:
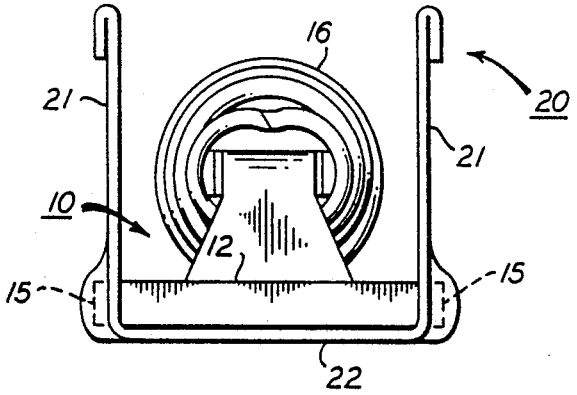
FIG. 4 is an end elevational view, similar to the view of FIG. 3, showing the previously arched region of the anchor plate flattened against the channel bottom.
Figure 5:
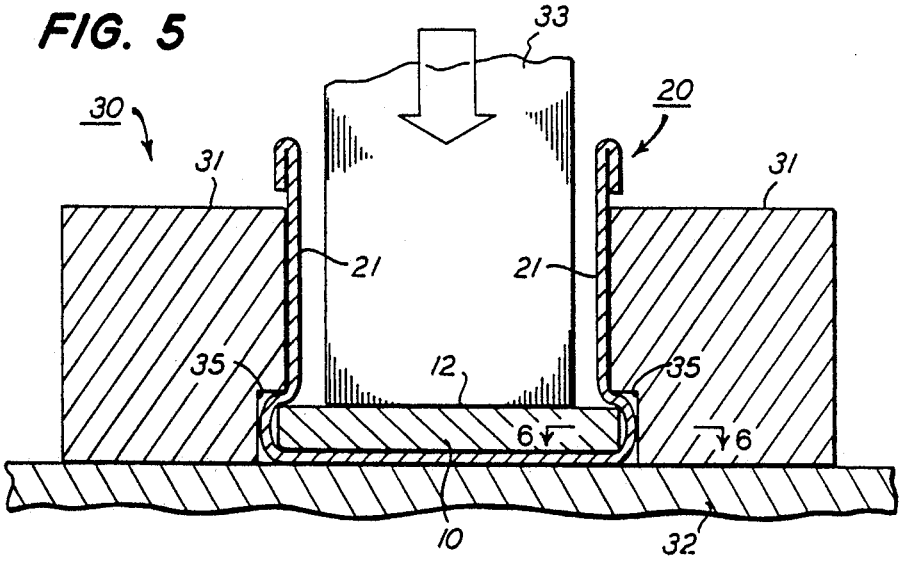
FIG. 5 is a cross-sectional view of the channel and the supporting tool and showing a stamp that flattens the arched region of the anchor plate to drive its edge projections into the channel side walls.
Figure 6:
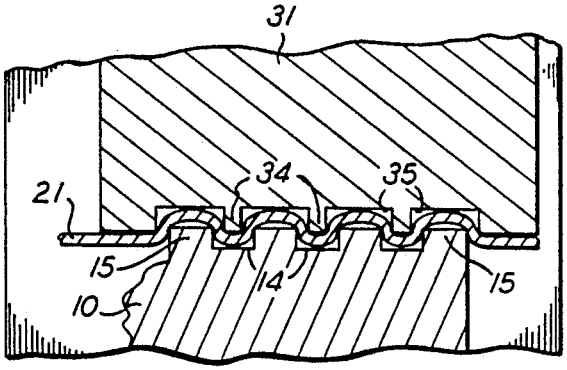
FIG. 6 is a fragmentary cross-sectional view of the channel, anchor plate, and tool of FIG. 5, taken along the line 6—6 thereof, and showing how the channel side wall is deformed around edge projections of the anchor plate.

Once anchor 10 is connected to spring 16, it can be arranged within channel 20, as shown in FIG. 3, where projections 15 fit inside channel side walls 21, above channel bottom 22. In this position, arched region 12 can be stamped flat against channel bottom 22, as shown in FIG. 4, to drive edge projections 15 into channel side walls 21 for an interlock that is best shown in FIGS. 5 and 6.

Before arched region 12 is stamped flat, channel 20 is supported in a tool 30 that includes side wall supports 31, bottom support 32, and movable stamp 33. Side wall supports 31 have recesses 35 that register with projections 15 on anchor 10. Recesses 35 are preferably larger than projections 15 by about twice the thickness of channel wall 21, so that wall 21 can be deformed around each projection 15 and into each recess 35, as anchor 10 is stamped flat. Between tool recesses 35 are projections 34 that register with anchor plate recesses 14 and hold channel wall 21 against deformation. This makes the deformed wall 21 extend over each projection 34 and into each anchor plate recess 14, as shown in FIG. 6. The result imposes a zigzag or S-curve in channel wall 21 for each projection 15 and recess 14 of anchor plate 10. With four projections, as shown in FIG. 6, channel wall 21 is defomed into a quadruple S-curve that interlocks with each projection 15 and each recess 14 of anchor plate 10.

The length of projections 15, and the extent that they deform channel side walls 21, is preferably arranged so that walls 21 do not crack or split open. This not only produces a better looking end result, but avoids potential weaknesses along any wall cracks that might occur.

Force exerted by spring 16 tends to pull anchor plate 10 longitudinally in channel 20, but deformed channel walls 21 resist this force effectively. We have found that anchor plate 10 can resist over 600 pounds of spring force, when interlocked with an aluminum channel, and over 1200 pounds of force when interlocked with a steel channel. This affords an adequate anchorage for the strongest of window balance springs.

For a production tool 30, side wall supports 31 are preferably movable laterally to facilitate positioning of channel 20 within tool 30. Once this is done and anchor plate 10 has its projections 15 registered with recesses 35 in side supports 31, stamp 33 presses downward within channel 20 to flatten the previously arched region 12 of anchor plate 10. This can be done rapidly, at a small cost, without required any preparatory work on channel 20. The stamping, by tool 33, accomplishes both the spreading of edge projections 15 of anchor plate 10 and the resulting deformation of channel wall 21, around projections 15 and into recesses 14, producing a completed interlock in a single blow. Combined with this is the simplicity and low cost of anchor plate 10, making our anchorage both less expensive and stronger and more reliable than previous solutions to the spring anchoring problem.

We claim:

1. An anchor for holding a window balance spring in a channel having side walls and a bottom, said anchor comprising:

a. an anchor plate connectable to the spring;

b. said anchor plate having opposed projections dimensioned to fit between said side walls of said channel; and c. said anchor plate having an arched region between said projections disposed so that when said anchor plate is positioned in said channel and said arch region is stamped flat against said bottom of said channel, said projections spread apart and deform said side walls of said channel to interlock said anchor plate with said channel.

2. The anchor of claim 1 wherein a neck extends from the anchor plate to a head so that terminal coils of said spring can be necked down around said neck to connect said anchor plate to said spring.

3. The anchor of claim 2 wherein said head has an abutment that interlocks with one of the necked down terminal coils of the spring.

4. The anchor of claim 1 wherein said anchor plate has several of said opposed projections separated by recesses along opposite edges of said anchor plate.

5. The anchor of claim 4 wherein said projections are square edged.

6. A system of anchoring a window balance spring within a channel, said system comprising:

a. a window balance spring and an anchor plate secured to an end region of said window balance spring;

b. said anchor plate having opposed projections at opposite edges of an initially arched region that allows said projections to be positioned between side walls of said channel; and c. said arched region of said anchor plate being flattened against a bottom of said channel to spread said opposed projections apart so that said projections extend into and deform said side walls of said channel for interlocking said anchor plate with said channel to resist the force of said balance spring.

7. The system of claim 6 wherein said anchor plate has several of said opposed projections arranged along said opposite edges.

8. The system of claim 7 wherein said side walls of said channel extend around said projections and into recesses between said projections.

9. The system of claim 6 wherein said anchor plate connects to an end region of said window balance spring by means of a head extending into said spring, a neck connecting said head to said anchor plate, and terminal coils of said spring being necked down around said neck to interlock with said head.

* * * * *